US007210176B2

(12) United States Patent
Weedling et al.

(10) Patent No.: US 7,210,176 B2
(45) Date of Patent: May 1, 2007

(54) PATIENT TRANSFER DEVICE HAVING INCLINED UPPER SURFACE

(76) Inventors: Robert E. Weedling, 4773 Pinehurst Cir., Center Valley, PA (US) 18034; James E. Weedling, 5456 Northwood Dr., Center Valley, PA (US) 18034; Daniel S. Gabbay, 2706 Ridge Rd. Dr., Alexandria, VA (US) 22302

( * ) Notice: Subject to any disclaimer, the term of this patent is extended or adjusted under 35 U.S.C. 154(b) by 0 days.

(21) Appl. No.: 11/065,473

(22) Filed: Feb. 24, 2005

(65) Prior Publication Data

US 2005/0193496 A1 Sep. 8, 2005

Related U.S. Application Data

(60) Provisional application No. 60/612,805, filed on Sep. 24, 2004, provisional application No. 60/548,901, filed on Mar. 2, 2004.

(51) Int. Cl.
*A61G 5/00* (2006.01)
*A61G 7/10* (2006.01)
*A61G 7/53* (2006.01)

(52) U.S. Cl. ..... 5/81.1 R; 5/706; 5/710

(58) Field of Classification Search ..... 5/81.1 R, 5/713, 710, 706

See application file for complete search history.

(56) References Cited

U.S. PATENT DOCUMENTS 3,339,544 A * 9/1967 Kravitz ..... 602/24
3,392,412 A * 7/1968 Aymar ..... 5/660
3,606,623 A 9/1971 Aymar
4,175,297 A * 11/1979 Robbins et al. ..... 5/284
4,259,757 A 4/1981 Watson
4,528,704 A 7/1985 Wegener et al.
4,627,426 A 12/1986 Wegener et al.
4,631,767 A 12/1986 Carr et al.
4,685,163 A * 8/1987 Quillen et al. ..... 5/710
4,686,719 A 8/1987 Johnson et al.
4,803,744 A * 2/1989 Peck et al. ..... 5/713
4,908,895 A * 3/1990 Walker ..... 5/711
4,941,221 A * 7/1990 Kanzler ..... 5/615
5,018,226 A * 5/1991 Davies et al. ..... 5/81.1 R
5,020,168 A * 6/1991 Wood ..... 4/573.1
5,048,136 A 9/1991 Popitz
5,065,464 A 11/1991 Blanchard et al.
5,067,189 A * 11/1991 Weedling et al. ..... 5/81.1 R
5,121,512 A * 6/1992 Kaufmann ..... 5/713

(Continued)

*Primary Examiner*—Patricia Engle
*Assistant Examiner*—Jonathan Liu
(74) *Attorney, Agent, or Firm*—Drinker Biddle & Reath LLP

(57) ABSTRACT

A patient transfer device includes a top sheet inclined in a head end portion such that a patient's torso is elevated with respect to the feet. The mattress may include relatively narrow chambers in an intermediate portion for increased strength and stability. The mattress may also include a leg separator in a foot end portion, preferably tapered and including one or more inflatable chambers. The mattress may also include a pump mounted directly to the mattress. The transfer device may include a torso and head support accessory having independently inflatable torso and head chambers and inlet and exhaust tubes connected to each chamber. A distribution manifold includes valves connected to each of the inlet and exhaust tubes for controlled inflation and deflation of the chambers. The device may include a control unit connected to the manifold and mountable to an intubation tube for actuation by a user's thumb.

13 Claims, 9 Drawing Sheets

U.S. PATENT DOCUMENTS 5,150,487 A 9/1992 Hemphill
5,184,365 A 2/1993 Stafford
5,243,721 A * 9/1993 Teasdale ..... 5/710
5,249,318 A 10/1993 Loadsman
5,345,630 A * 9/1994 Healy ..... 5/708
5,528,783 A 6/1996 Kunz et al.
RE35,299 E 7/1996 Weedling et al.
5,561,873 A 10/1996 Weedling
5,566,409 A * 10/1996 Klearman ..... 5/723
5,678,265 A * 10/1997 Meyer ..... 5/654
5,740,573 A * 4/1998 Boyd ..... 5/711
5,742,958 A * 4/1998 Solazzo ..... 5/81.1 R
5,807,290 A * 9/1998 Barry ..... 602/3
D419,495 S * 1/2000 Muhanna ..... D12/133
6,047,420 A 4/2000 Priester, III
6,073,291 A * 6/2000 Davis ..... 5/711
6,079,070 A * 6/2000 Flick ..... 5/715
6,108,843 A * 8/2000 Suzuki et al. ..... 5/713
6,138,306 A 10/2000 Muhanna
6,151,735 A 11/2000 Koby
6,233,768 B1 * 5/2001 Harding ..... 5/735
6,240,584 B1 6/2001 Perez et al.
6,298,511 B1 * 10/2001 Collymore ..... 5/715
6,397,415 B1 6/2002 Hsieh
6,401,279 B1 6/2002 Vaughn
6,446,288 B1 9/2002 Pi
6,481,031 B1 11/2002 Hwang
6,499,166 B1 * 12/2002 Jones ..... 5/689
6,510,574 B2 1/2003 Sharrock
6,568,012 B2 * 5/2003 Michaelis et al. ..... 5/706
6,568,013 B2 * 5/2003 Perez et al. ..... 5/710
6,604,252 B1 * 8/2003 Lee et al. ..... 5/715
6,671,910 B2 * 1/2004 Hsu et al. ..... 5/710
6,694,556 B2 * 2/2004 Stolpmann ..... 5/710
6,739,007 B1 5/2004 Talai
6,751,818 B2 6/2004 Troop
6,763,540 B1 * 7/2004 Wang ..... 5/710
6,820,292 B2 * 11/2004 Heimbrock ..... 5/81.1 R
6,848,137 B1 * 2/2005 Barnes ..... 5/710
6,886,204 B2 * 5/2005 Kasatshko et al. ..... 5/722
6,935,340 B2 8/2005 Saied
7,007,330 B2 * 3/2006 Kuiper et al. ..... 5/715
2001/0023512 A1 9/2001 Perez et al.
2002/0166168 A1 * 11/2002 Weedling et al. ..... 5/81.1 R
2003/0070226 A1 * 4/2003 Heimbrock ..... 5/81.1 R
2003/0159212 A1 * 8/2003 Patrick et al. ..... 5/81.1 R
2005/0193493 A1 9/2005 Gabbay

* cited by examiner

PATIENT TRANSFER DEVICE HAVING INCLINED UPPER SURFACE

CROSS-REFERENCE TO RELATED APPLICATIONS

This application claims priority of U.S. Provisional Application No. 60/612,805, filed Sep. 24, 2004, entitled "Patient Transfer Mattress Having Inclined Surface", and U.S. Provisional Application No. 60/548,901, filed Mar. 24, 2004, entitled "Active Head/Neck Positioning Device for Intubation", each incorporated herein by reference in its entirety.

FIELD OF THE INVENTION

The present invention relates to a patient transfer device. More particularly, the present invention relates to a patient transfer mattress with an inclined surface, which may be useful for supporting obese patients in a more upright posture to ease the burden of breathing or to facilitate patient intubation regardless of patient weight.

BACKGROUND OF THE INVENTION

Patient transfer mattresses have an inflatable plenum and discharge air through a plurality of holes in a bottom sheet to create a cushion of air beneath the mattress. The air cushion lifts and facilitates movement of the mattress with respect to a bed or other support surface. Some contemporary examples of patient transfer mattresses are disclosed in U.S. Pat. No. 5,067,189 (Weedling et al), reissued as U.S. Pat. No. Re. 35,299, and U.S. Pat. No. 5,561,873 (Weedling).

Patients, particularly those that are morbidly obese, often have coexisting physical conditions that make it unhealthy for the patient to lay in a flat supine condition for extended lengths of time. Obesity can contribute to respiratory difficulty as the lungs are compressed by the heavy chest wall making it difficult for the lungs to lift and expand to inhale. This breathing difficulty can aggravate other conditions such as Chronic Obstructive Pulmonary Disease (COPD) and Congestive Heart Failure (CHF).

For these reasons obese patients, particularly those with COPD or CHF, can have a stressful time while lying flat during diagnostic procedures or while being transferred from one rest surface to another. Arterial blood gas levels for obese patients maintained in a supine condition can increase to a level that impairs proper circulation of oxygen. For patients with CHF, the heart may not be able to adequately pump blood throughout the body, and blood may accumulate in the lungs, causing shortness of breath, fatigue, and edema of the extremities. When the lungs become congested with fluid, the resulting shortness of breath frequently causes CHF patients to experience sleep interruptions.

Patient treatment often requires endotracheal intubation. Direct visualization of the larynx using a rigid laryngoscope constitutes the primary procedure of achieving endotracheal intubation, and the procedure is called laryngoscopy. Successful laryngoscopy is contingent upon alignment of the oral, pharyngeal and laryngeal axes. In this position, sometimes referred to as the "sniffing position", the patient's head is slightly extended and the occiput is elevated. Placing a patient in the proper intubation position by manual manipulation is somewhat difficult, however, and the difficulty increases when the patient is obese.

Consequently, others have developed body support devices to facilitate endotracheal intubation. U.S. Pat. No. 4,259,757 (Watson) discloses a cushion that can be used to position a patient's head and neck to facilitate endotracheal intubation. The cushion, however, supports only the head and neck and does not support the torso of the patient to provide a full support system for achieving the sniffing position. U.S. Pat. No. 5,528,783 discloses a wedge-shaped head and torso support including an inflatable bladder. The bladder is adjustable to provide for partial inflation as well as full inflation. The support includes only one bladder and, therefore, is incapable of providing elevation of the head independently from that of the torso.

SUMMARY OF THE INVENTION

According to one aspect of the invention, a patient transfer device includes an inflatable transfer mattress having a top sheet and a bottom sheet. The bottom sheet includes holes to create a cushion of air beneath the mattress. The top sheet is inclined from an intermediate lengthwise position upward toward the head end of the mattress, such that the head and upper torso of a supported patient are raised above the legs and lower torso.

In one embodiment, the inflatable transfer mattress includes a plurality of relatively narrow chambers in an intermediate portion of the mattress to provide increased strength and stability in the intermediate portion for supporting a patient on the mattress in an inclined condition. Preferably, the relatively narrow chambers extend transversely with respect to the mattress.

In another embodiment, the transfer mattress includes a leg separator located in a foot portion of the top sheet of the mattress. The leg separator is preferably tapered to widen toward an end of the mattress. Preferably, the leg separator includes at least one inflatable chamber having at least one inlet port for inflation of the chamber. The leg separator may include a plurality of chambers separated from each other by baffle walls.

In another embodiment, the transfer mattress includes a pump mounted to the mattress and connected to at least one inlet port of the mattress. The pump may be connected to one or more inlet ports of the mattress by a hose. Alternatively, the pump may be mounted directly to an inlet port.

According to another aspect of the invention, a patient transfer device includes a torso and head support. The torso support has an inflatable chamber, and the head support is located on an upper surface of the torso support and also has an inflatable chamber. The upper surface of the torso support is inclined upward with respect to an underlying support surface when the torso support chamber is inflated such that a patient's upper torso is elevated with respect to the patient's legs and feet. The head support chamber defines an interior that is separated from an interior of the torso support chamber to provide for independent inflation of the respective chambers.

In one embodiment, the patient transfer device includes an inlet tube connected to each of the support chambers for delivering pressurized air to inflate the associated chamber. The patient transfer device also includes a distribution manifold operably connected to a source of pressurized air and first and second valves, each connected to one of the inlet tubes, for controlled delivery of pressurized air to the associated chamber. Preferably, the valves are electrically controlled valves. The patient transfer device further includes a controller connected to the distribution manifold and adapted to control the operation of the valves for independent inflation of the torso support chamber and the head support chamber.

In another embodiment, the patient transfer device also includes exhaust tubes connected to each of the torso support chamber and the head support chamber for discharging air from the associated chamber. The distribution manifold includes third and fourth valves connected to the exhaust tubes for controlled deflation of the associated chamber.

In another embodiment, the patient transfer device includes a control system including a control unit connected to the distribution manifold for controlling the operation of the valves. According to one preferred embodiment, the control unit is adapted for mounting to a laryngoscope for actuation of the valves by a user's thumb to align the three axes to the sniffing position.

DESCRIPTION OF THE INVENTION

Figure 1:
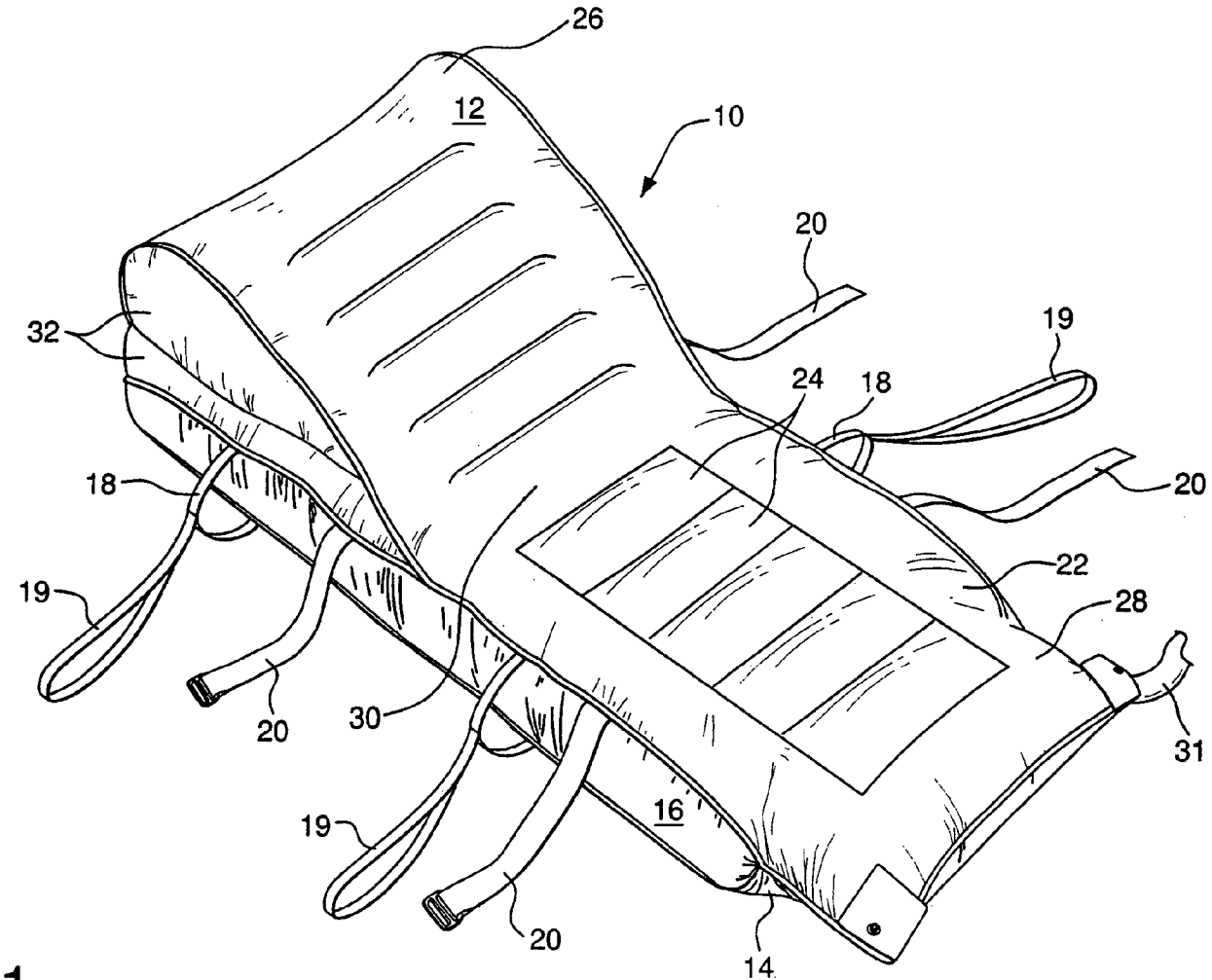
FIG. 1 is a perspective view of a patient transfer device according to the present invention.

Referring to the drawings, where like numerals identify like elements, there is shown in FIG. 1 a patient transfer device of the type having an inflatable mattress 10. As will be described in greater detail below, the patient transfer device provides an inclined surface for supporting a patient's head and torso in an elevated condition with respect to the patient's lower torso and legs. Support in this manner is desirable for obese patients, particular for obese patients having coexisting conditions such as Chronic Obstructive Pulmonary Disease (COPD) and Congestive Heart Failure (CHF).

The inflatable transfer mattress 10 includes a top sheet 12, a bottom sheet 14 and side panels 16. The bottom sheet 14 includes a plurality of openings for discharging air from the mattress 10 to create an air cushion beneath the mattress to facilitate sliding of the mattress 10 along an underlying support surface. The transfer mattress 10 may include looped handles 18 secured to the sides of the mattress 10 to facilitate application of a pulling force to guide the movement of mattress.

The transfer mattress 10 may also include looped pull straps 19 secured to each of the looped handles 18. The looped pull straps 19 are elongated to allow a caregiver to grasp and pull at a distance from the mattress 10. This situation could present itself, for example, when it is desired to transfer a patient from a first support surface to a second surface located between the caregiver and the first support surface. The elongated looped pull straps 19 allow the caregiver to apply a pulling force to the mattress while the caregiver's back is in a substantially upright condition to reduce the likelihood of back injury. The transfer mattress 10 may also include patient restraint straps 20 for securing a patient to the mattress.

The patient transfer mattress 10 preferably includes longitudinally extending side air chambers 22 and transverse chambers 24 extending between the side chambers 22. Some suitable constructions for the side air chambers 22 and transverse chambers 24 of mattress 10 are described in U.S. Pat. No. 5,067,189 (Weedling), reissued as U.S. Pat. No. RE 35,299, and U.S. Pat. No. 5,561,873.

The patient transfer mattress 10 includes a head portion 26 at one end, a foot portion 28 at an opposite end, and an intermediate portion 30 located between the head and foot portions 26, 28. The head portion 26 of the transfer mattress 10 includes expansion panels 32 located between the top and bottom sheets 12, 14 and connected to the side panels 16. As shown in FIG. 1, the inclusion of the expansion panels 32 results in elevation of the top sheet 12 in the head portion 26 of the mattress 10 above the rest of the top sheet 12 when the transfer mattress 10 is inflated. As shown, the expansion panels 32 are dimensioned such that the top sheet 12 is inclined at a substantially uniform rate throughout a majority of the head portion 26. Preferably, the angle of inclination, $\Theta$, of top sheet 12 in the head portion 26 with respect to the rest of the top sheet 12 is between approximately 30 degrees and approximately 40 degrees when fully inflated and not loaded by a patient. The invention, however, is not limited to any particular angle of inclination.

The inclination elevates the head and upper torso of a supported patient above the patient's lower torso and legs. Supporting an obese patient in a more upright position facilitates circulation and respiration, both at rest and lateral transfer.

The transfer mattress 10 includes an air inlet hose 31 for supplying air to the interior to inflate the mattress. The inclined head portion 26 of transfer mattress 10 may have an interior chamber that communicates with the interior of the remainder of the transfer mattress 10. Constructed in this manner, the entire transfer mattress 10, including the inclined head portion 26, would be inflated in common from the same source of air via the air inlet hose 31. Alternatively, the inclined surface of the head portion 26 of patient transfer mattress 10 may define a torso support chamber that is isolated from the remainder of the transfer mattress. Arranged in this manner, the torso support chamber could receive a static supply of air through an inlet valve for optional inflation of the torso support chamber when desired. Such an arrangement provides the option of supporting a patient in a substantially supine condition or in a more upright position.

Figure 2:
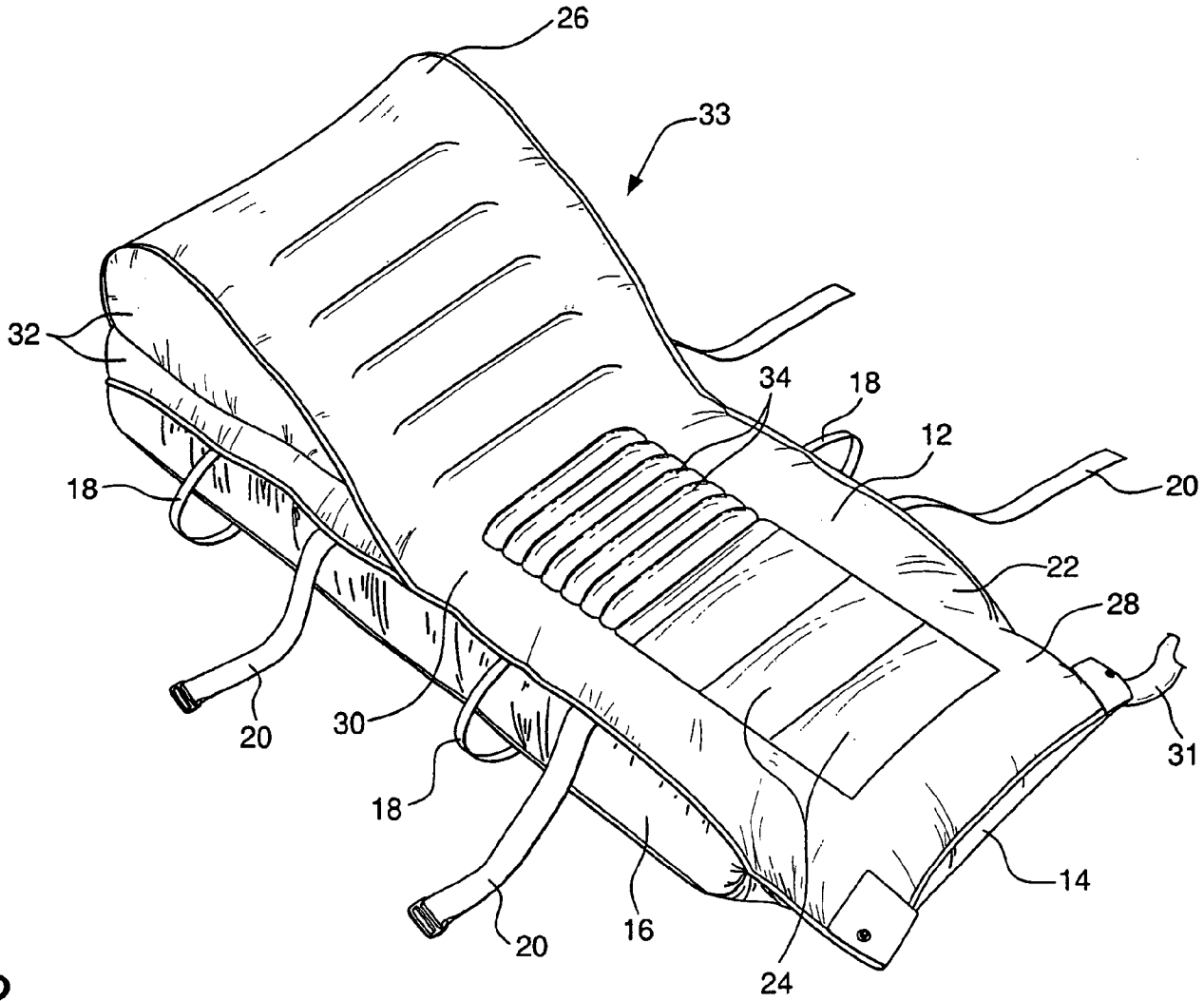
FIG. 2 is a perspective view of a patient transfer device according to a second embodiment of the invention.

FIG. 2 shows a second embodiment of a patient transfer device according to the invention in the form of a patient transfer mattress 33. Similar to patient transfer mattress 10 of FIG. 1, the patient transfer mattress 33 includes top and bottom sheets 12, 14, side panels 16, looped handles 18 and patient restraint straps 20. Also similar to transfer mattress 10, the mattress 33 includes expansion panels 32 in a head portion 26 of the mattress 33 resulting in elevation of the head portion 26 above the rest of the top sheet 12 when the transfer mattress 33 is inflated.

The inclination of the top sheet 12 and elevation of the patient's upper torso will tend to distribute a larger percentage of the patient's weight to the intermediate portion 30 of the transfer mattress 33 than when the patient is supine. To compensate for this increased weight, the intermediate portion 30 of transfer mattress 33 includes transverse chambers 34 that are narrower in width than the transverse chambers 24 included in other parts of the mattress 33. As a result, the density of the transverse chambers 34 (i.e., the number of chambers per unit area) is increased in the intermediate portion 30 such that the weight that each chamber 34 must bear is reduced in comparison to that required if the relatively wider transverse chambers 24 were used. Preferably, the transverse chambers 34 of the intermediate portion 30 of mattress 33 open directly into the longitudinal side chambers 22 of transfer mattress 33. Although it is preferred that the narrowed chambers of the intermediate portion 30 extend transversely, it is not required.

Figure 3:
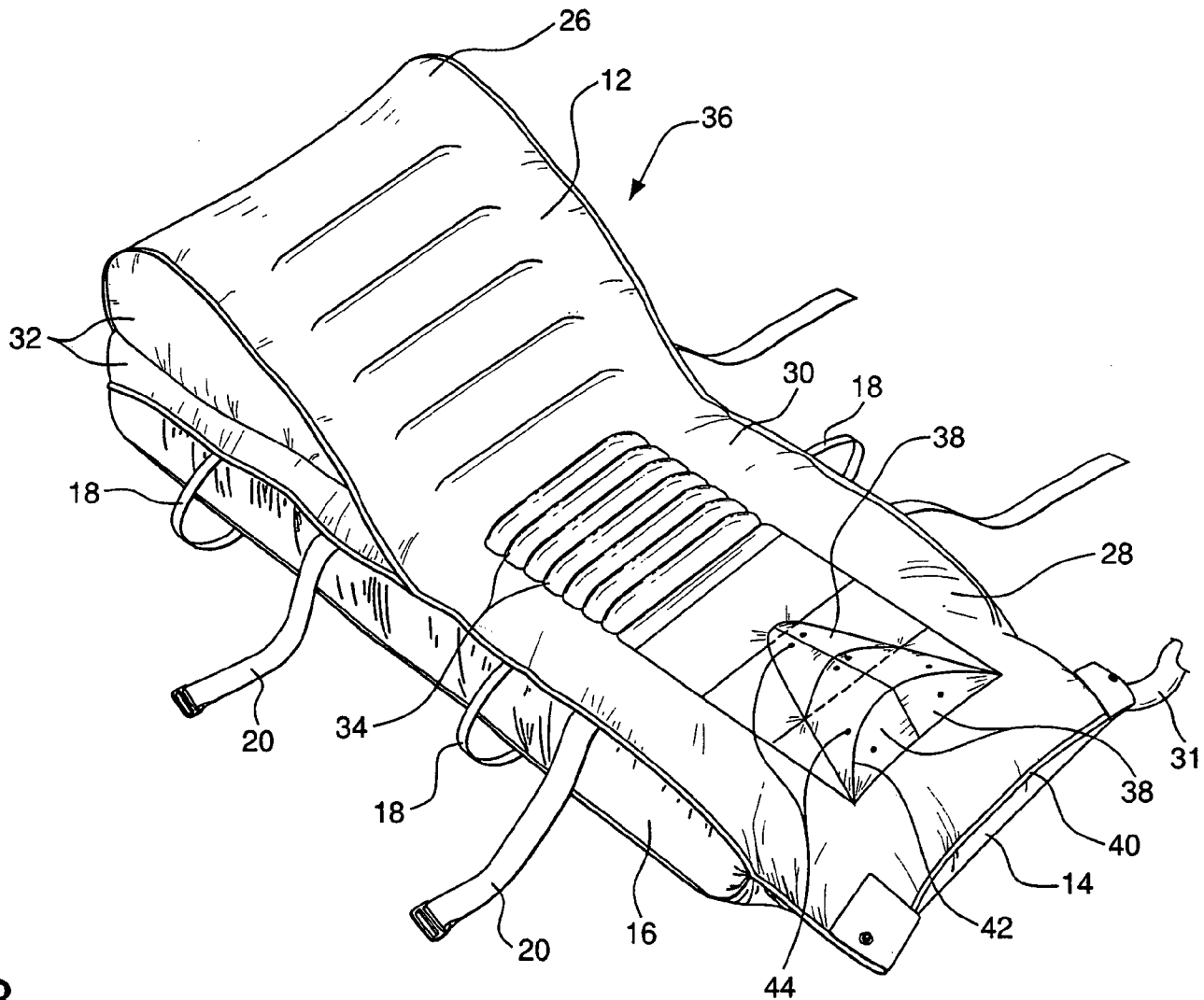
FIG. 3 is a perspective view of a patient transfer device according to a third embodiment of the invention.

Referring to FIG. 3, there is illustrated a patient transfer device according to a third embodiment of the invention in the form of a transfer mattress 36. The transfer mattress 36 includes a top sheet 12, a bottom sheet 14, side panels 16 and expansion panels 32 similar to those of transfer mattresses 10 and 33 such that the top sheet 12 is inclined in the head portion 26 of transfer mattress 36. Also similar to patient transfer mattress 33, the transfer mattress 36 includes relatively narrow transverse chambers 34 in the intermediate portion 30 of the mattress 36 for increased support and stability in the intermediate portion 30.

Transfer mattress 36 also includes a cluster of inflatable chambers 38 secured to the top sheet 12 in the foot portion 28 of mattress 36. The cluster of chambers 38, when inflated, creates a tapered formation that increases in width towards end 40 of mattress 36. This tapering formation acts like a wedge tending to maintain separation between the legs of a patient supported on the mattress 36. For obese patients, leg separation promotes circulation and preserves skin integrity. Preferably, the chambers 38 are separated from each other by baffle walls 42 for increased strength of the cluster. Accordingly, each of the chambers 38 of the leg separating cluster includes at least one inlet port 44 for inflation. It should be understood that it not necessary that the inflatable leg separator include a cluster of multiple chambers. The leg separator could include a single chamber forming the wedge-like configuration shown. It is also not a requirement that the leg separator be inflatable. The leg separator could, alternatively, comprise a material such as foam secured to the top sheet 12 of mattress 36.

The transfer mattress 36 preferably includes a top sheet 12 inclined in the head portion 26 of mattress 36 and narrow transverse chambers 34 in the intermediate portion 30. The invention, however, is not limited to this construction. The leg separator described in the preceding paragraph could be included on any transfer mattress having substantially uniform transverse chambers 24 throughout the mattress, or on a transfer mattress having a top sheet that is not inclined in the head portion.

Figure 4:
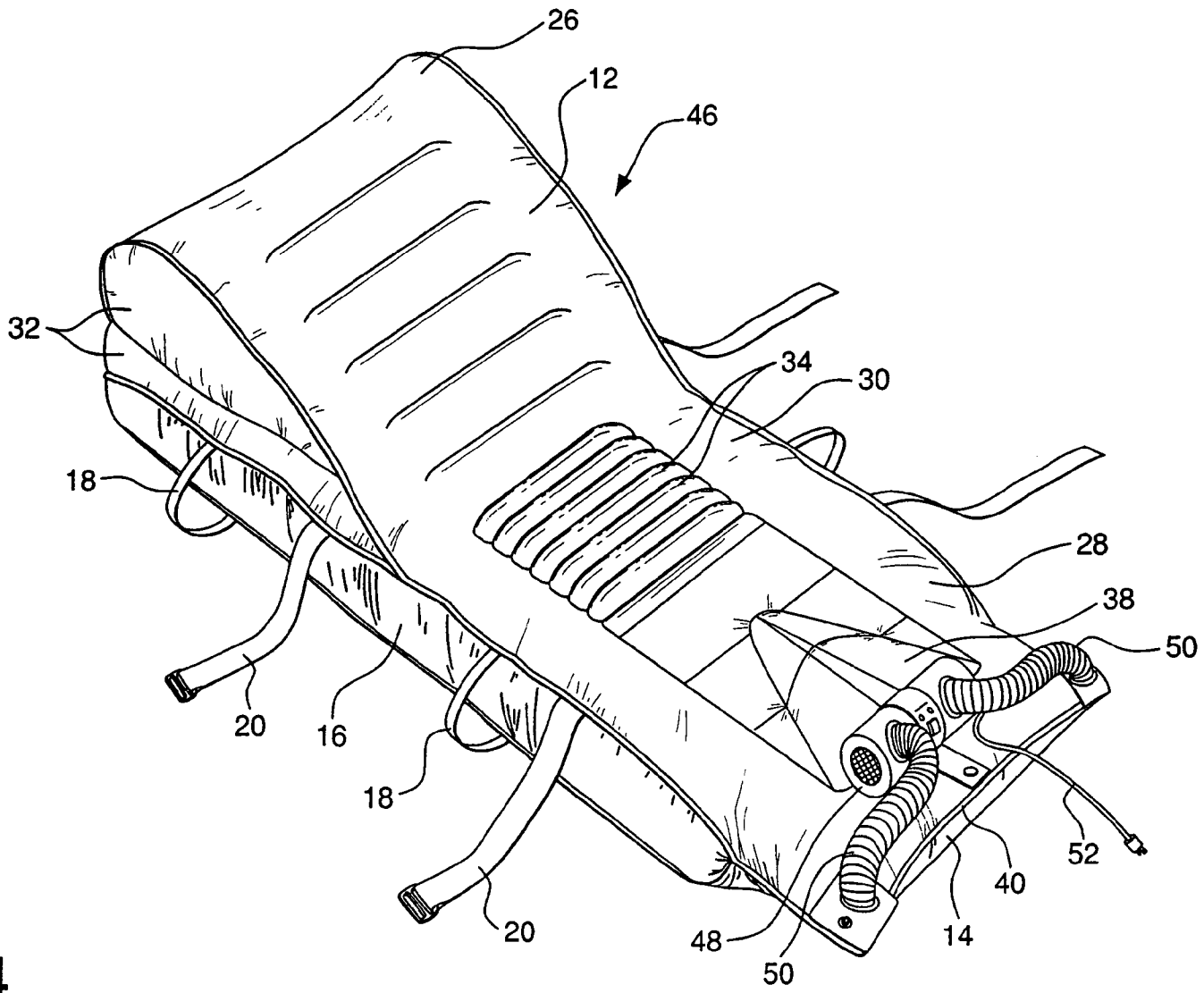
FIG. 4 is a perspective view of a patient transfer device according to a fourth embodiment of the invention.

FIG. 4 shows a patient transfer device according to a fourth embodiment of the invention in the form of an air transfer mattress 46. Similar to transfer mattresses 10 and 33, the transfer mattress 46 preferably includes a top sheet 12 that is inclined in a head portion 26. It is also preferable that the transfer mattress 46 includes an intermediate portion 30 having relatively narrow transverse chambers 34, like transfer mattresses 33 and 36, and a leg separator formed by a cluster of chambers 38, like transfer mattress 36.

As shown in FIGS. 1 through 3, each of transfer mattresses 10, 33, and 36, includes an inlet hose 31 for supplying air from an air source to inflate the transfer mattress. Transfer mattress 46 includes an inflator 48 mounted directly to the transfer mattress for inflating the mattress. The inflator 48 is preferably mounted to the foot portion 28 of transfer mattress 46 adjacent to the mattress end 40. The inflator 48 includes a pair of hoses 50 connected to inlet ports located on opposite sides of the mattress 46 adjacent end 40. The inflator 48 includes a power cord 52 adapted for engagement with an electrical socket. Alternatively, the inflator 48 could include its own battery source for power. It is not required that inflator 48 include a pair of inlet hoses 50 and could, instead, have only one hose. Alternatively, the transfer mattress 46 could include a single inlet port to which the inflator is directly connected, thereby eliminating the need for a hose to interconnect the inflator and the inlet port. Although the inflator 48 is shown mounted to the foot portion 28 of mattress 46, it should be understood that the inflator could conceivably be mounted to the mattress 46 at another location.

The transfer mattress 46 preferably includes a top sheet 12 inclined in the head portion 26, narrow transverse chambers 34 in the intermediate portion 30, an inflator 48, and a leg separator in the foot portion 28. The invention, however, is not limited to this construction. It is conceivable, for example, that the inflator 48 described in the preceding paragraph could be used with any transfer mattress, including those which do not include a leg separator, or which have substantially uniform transverse chambers 24 throughout, or a transfer mattress having a top sheet that is not inclined in the head portion.

Figure 5:
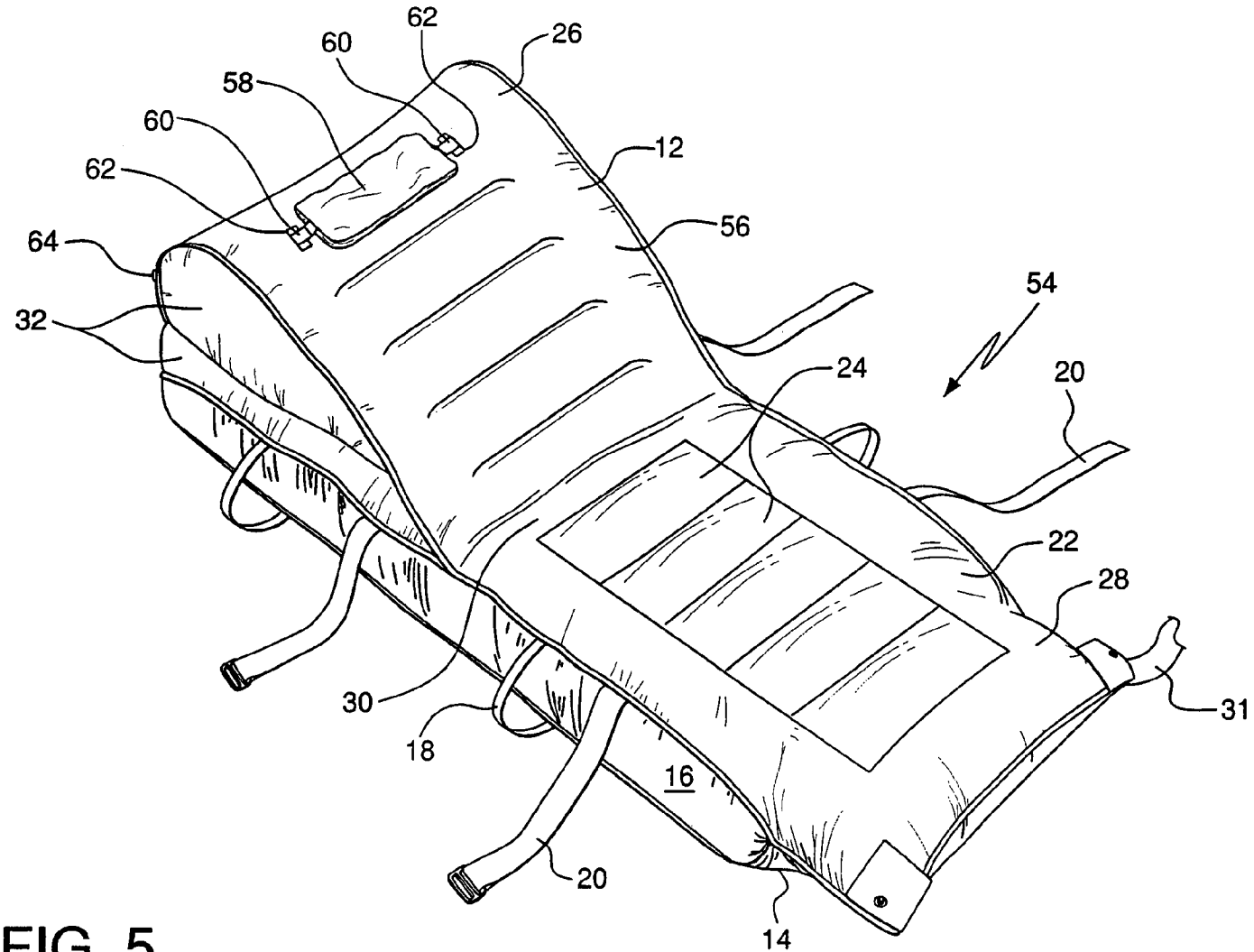
FIG. 5 is a perspective view of a patient transfer device according to a fifth embodiment of the invention, shown with a head support pillow in a deflated condition.
Figure 6:
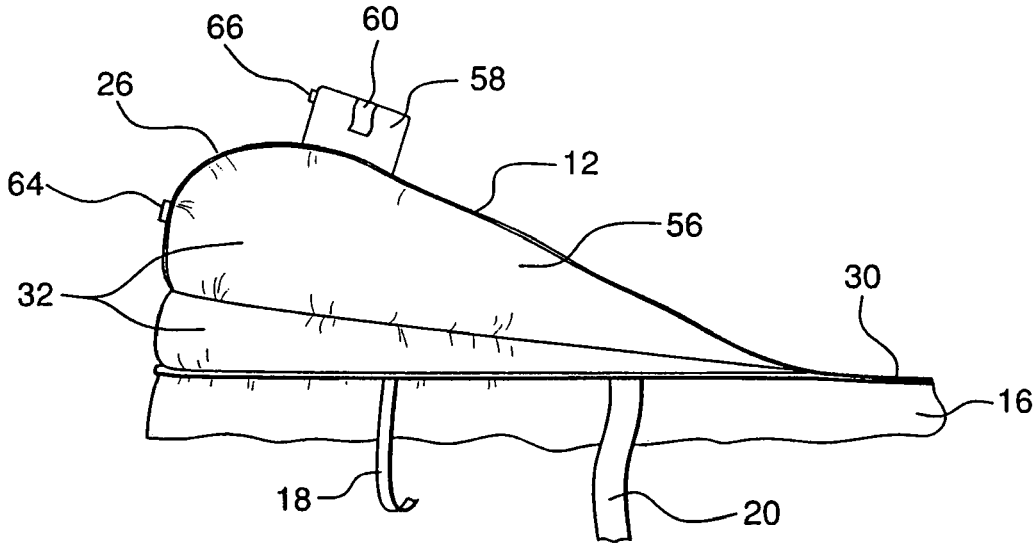
FIG. 6 is a partial side elevation view of the patient transfer device of FIG. 5, shown with the head support pillow in an inflated condition.

FIGS. 5 and 6 show a patient transfer device according to a fifth embodiment of the invention in the form of a transfer mattress 54. Similar to transfer mattress 10 of FIG. 1, transfer mattress 54 includes top and bottom sheets 12, 14, side panels 16, looped handles 18 and patient restraint straps 20. Also similar to transfer mattress 10, the transfer mattress 54 has expansion panels 32 in a head portion 26 of the mattress providing an inflatable torso support chamber 56 for inclining the top sheet 12 in the head portion 26. Similar to mattress 10, the inflatable torso support chamber 56 could be separated from the main plenum defined by the remainder of the mattress 54 for separate inflation by its own air supply. Alternatively, the inflatable torso support chamber 56 could communicate with the main plenum for common air supply.

The transfer mattress 54 further includes a head support chamber 58 connected to the top sheet 12 in the head portion 26. The head support chamber 58 of mattress 54 preferably communicates with the torso support chamber 56 for inflating the head support chamber 58 with air from the torso support chamber 56. The head support chamber 58 is shown in FIG. 5 in a deflated condition. Straps 60 secured to opposite sides of the head support chamber 58 are releasably attached to tabs 62 mounted to the top sheet 12 to maintain the head support chamber 58 in the deflated condition. The straps 60 and tabs 62 preferably carry hook and loop fastener material to provide for the desired releasable attachment. However, any suitable fastening means such as snaps, for example, could be used instead.

Referring to FIG. 6, the straps 60 have been released from the tabs 62 to permit air from the torso support chamber 56 to inflate the head support chamber 58. The inflation of the head support chamber 58 provides for the support of a patient's head in an elevated condition, with the chin pivoted slightly toward the chest. As shown in FIG. 6, the torso and head support chambers 56, 58 preferably include valves 64, 66 for controlling the inflation pressure in the respective chambers. The inclusion of separate torso and head chambers 56, 58, and independent control over the amount of inflation of the respective chambers, provides for independent elevation adjustment of a patient's torso and head to facilitate an endotracheal intubation of the patient, as described in greater detail below.

Figure 7:
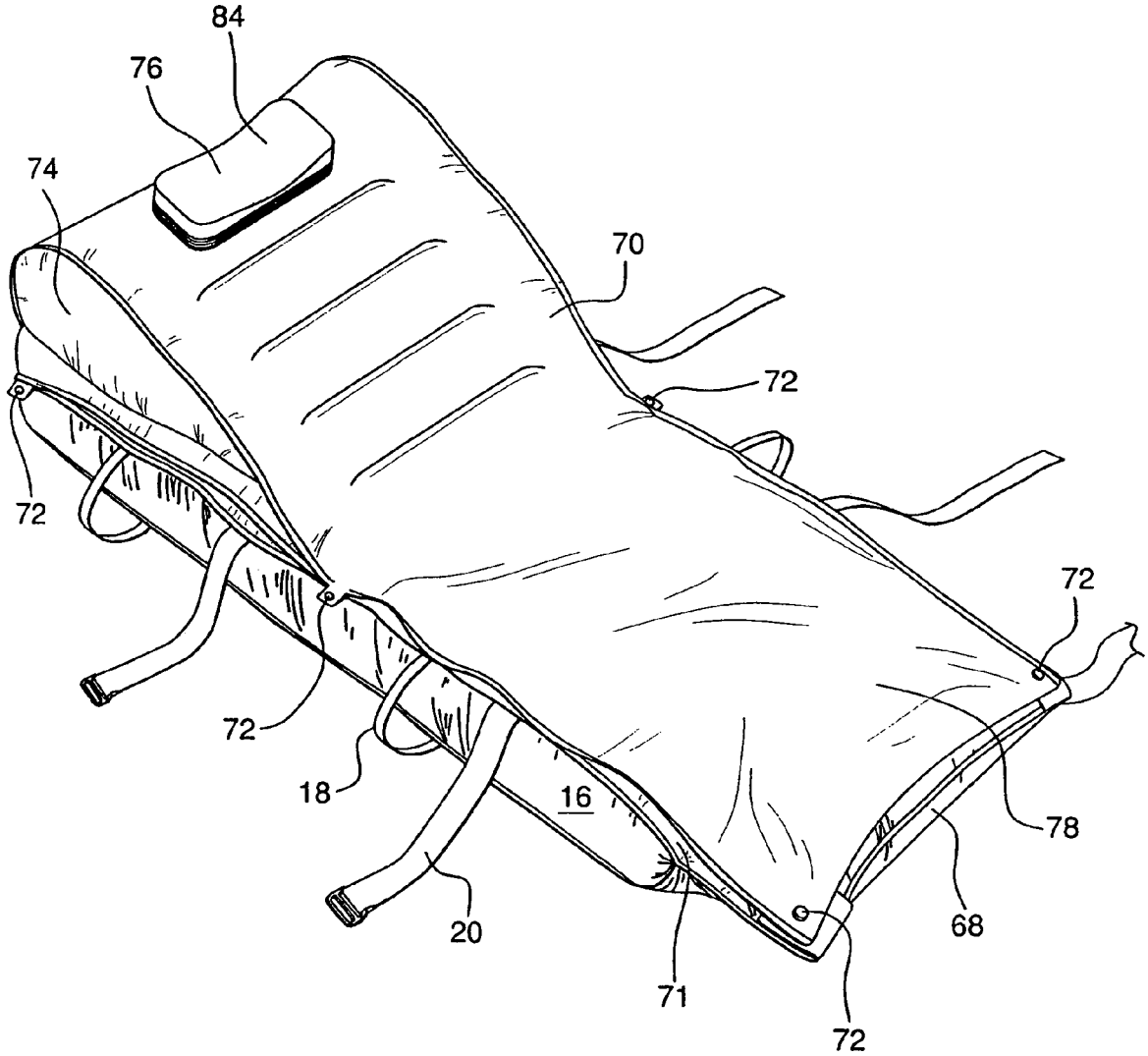
FIG. 7 is a perspective view of a patient transfer device according to a sixth embodiment of the invention.
Figure 8:
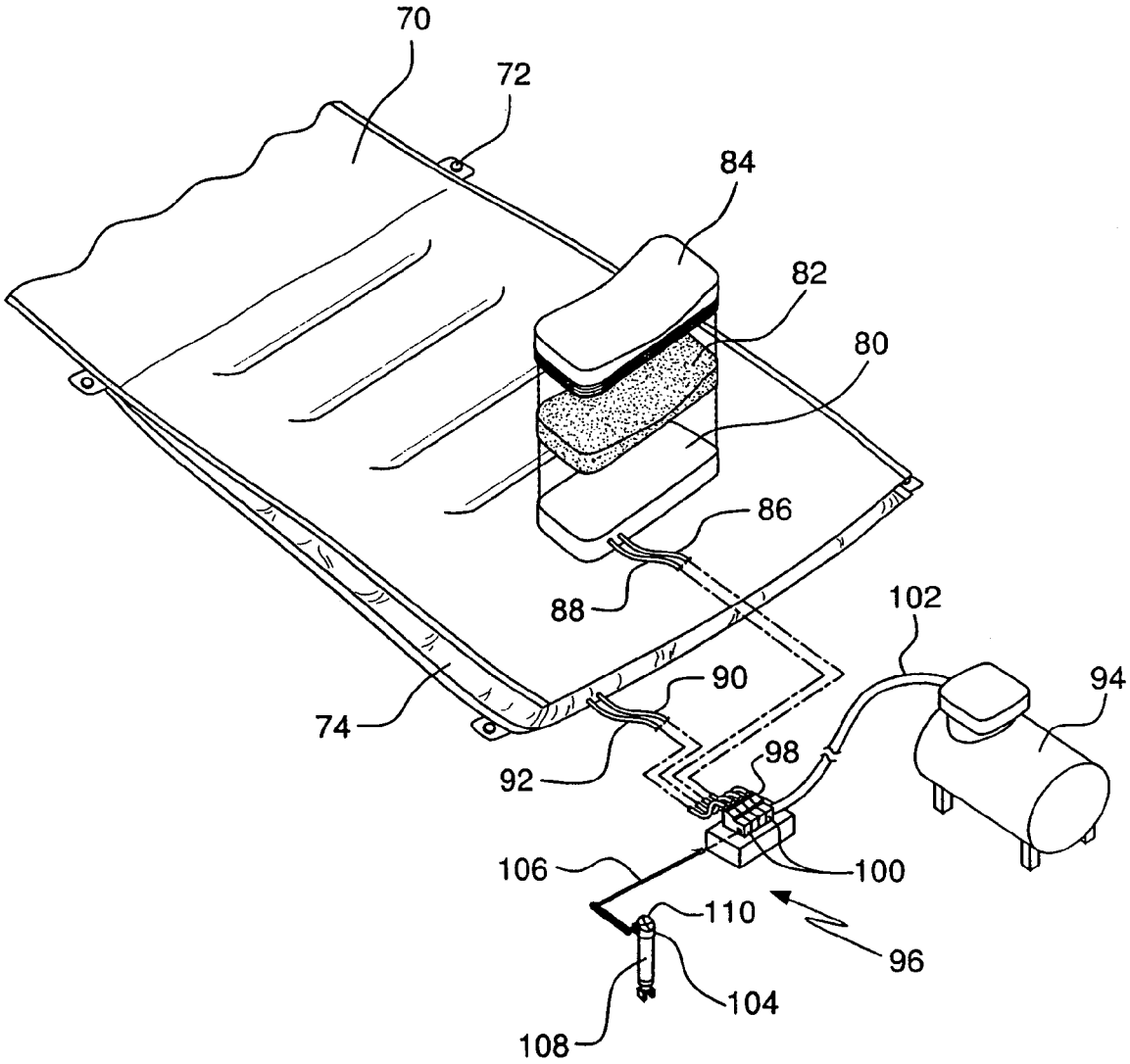
FIG. 8 is a partial perspective view of the inflatable head/torso support attachment of the patient transfer device of FIG. 7 including an inflation control system providing independent inflation of the head and torso bladders.

FIGS. 7 and 8 show a patient transfer device according to a sixth embodiment of the invention in the form of an inflatable transfer mattress 68 and an inflatable torso and head support as an accessory 70 that can be attached to the transfer mattress 68. The inflatable transfer mattress, in conventional fashion, includes a top sheet 71 providing for substantially supine support of a patient. As shown in FIG. 7, the inflatable transfer mattress 68 and the torso and head support accessory 70 include fasteners 72 for releasable attachment of the torso and head support accessory 70 to the transfer mattress 68. The releasable attachment of the torso and head support accessory 70 provides for use of the underlying mattress 68 with or without torso and head elevation.

The torso and head support accessory 70 includes an inflatable torso chamber 74 and an inflatable head pillow 76 located on an upper surface of the torso chamber 74. The torso and head support accessory 70 also includes a foot end portion 78 connected to the torso chamber 74. As shown in FIG. 7, the torso chamber 74 and foot end portion 78 are preferably dimensioned such that the torso and head support accessory 70 covers substantially all of the upper surface of the underlying inflatable mattress 68.

As shown in FIG. 7, the torso chamber 74 is wedge-shaped when inflated such that the upper surface is inclined to elevate a patient's upper torso with respect to the patient's lower torso and legs. The foot end portion 78 of the torso and head support 70 is not inflatable. Inflation of the foot end portion 78 is not necessary as the underlying transfer mattress 68 provides the necessary support to transfer a patient.

Referring to FIG. 8, the torso chamber 74 and head pillow 76 of the torso and head support accessory 70 are shown in greater detail. The head pillow 76 includes an inflatable chamber 80 defining an interior that is separated from an interior of the torso chamber 74 to provide for separate inflation of the torso chamber 74 and head pillow 76. The head pillow 76 also includes a cushion 82, preferably made from foam material, located above the inflatable chamber 80. The cushion 82 includes a concavely curved upper surface. The head pillow 76 also includes a cover 84 enclosing the chamber 80 and cushion 82. The cover 84 includes a concavely curved upper surface corresponding to the upper surface of the cushion 82. The cover 84 also includes accordion-like formations at a lower end of the cover 84 to provide for expansion and collapse of the cover 84 depending on whether the enclosed chamber 80 is inflated or deflated.

As shown in FIG. 8, the torso and head support accessory 70 includes a first pair of tubes 86, 88 connected to the chamber 80 of the head pillow 76 and a second pair of tubes 90, 92 connected to the torso chamber 74. This arrangement provides for independent inflation of the torso chamber 74 and head pillow 76 from air supplied by a source of pressurized air, preferably a compressor 94. In each of the tube pairs, one of the tubes provides for inlet of air to the associated chamber while the other provides for discharge of air from the chamber. The torso and head support accessory 70 also has an inflation control system 96 including an air distribution manifold 98 for controlling inlet and discharge of air to the torso chamber 74 and head pillow 76. As described below in greater detail, the inflation control system 96 is capable of making very fine adjustments in the amount of inflation in either or both of the torso chamber 74 and the head pillow chamber 80.

The air distribution manifold 98 includes four valves 100 each connected to one of the tube 86, 88, 90, 92. The valves 100 control the inflow of air to, or the exhaust of air from, the respective chambers 74, 80 and are preferably electrically controlled valves. Electrically controlled valves for controlling air flow are well known and no further description is necessary. The air distribution manifold 98 is connected to the compressor 94 by a line 102 to deliver compressed air from the compressor 94 to the air distribution manifold 98. Preferably, the line 102 is also configured to carry electrical power supply to the distribution manifold 98 for powering the electrically operated valves 100 of the distribution manifold 98.

The inflation control system 96 also includes a control unit 104 connected to the air distribution manifold 98 by a cord 106 for controlling the operation of the valves 100. The control unit 104 is shown mounted to the end of an intubation handle 108 adapted for grasped receipt by a user's hand. Arranged in this manner, the control unit 104 can be actuated by an intubator's thumb allowing the intubator to make fine-tuned adjustments to the inflation of the torso/head chambers 74, 80 without having to look away from the patient. As shown, the control unit 104 includes four thumb-switches 110 arranged in a circular array for separate actuation of the four valves 100. Although the above-described handle mounted arrangement desirably facilitates an intubation procedure, the present invention is not limited to any particular control configuration and could vary from that shown.

Figure 9:
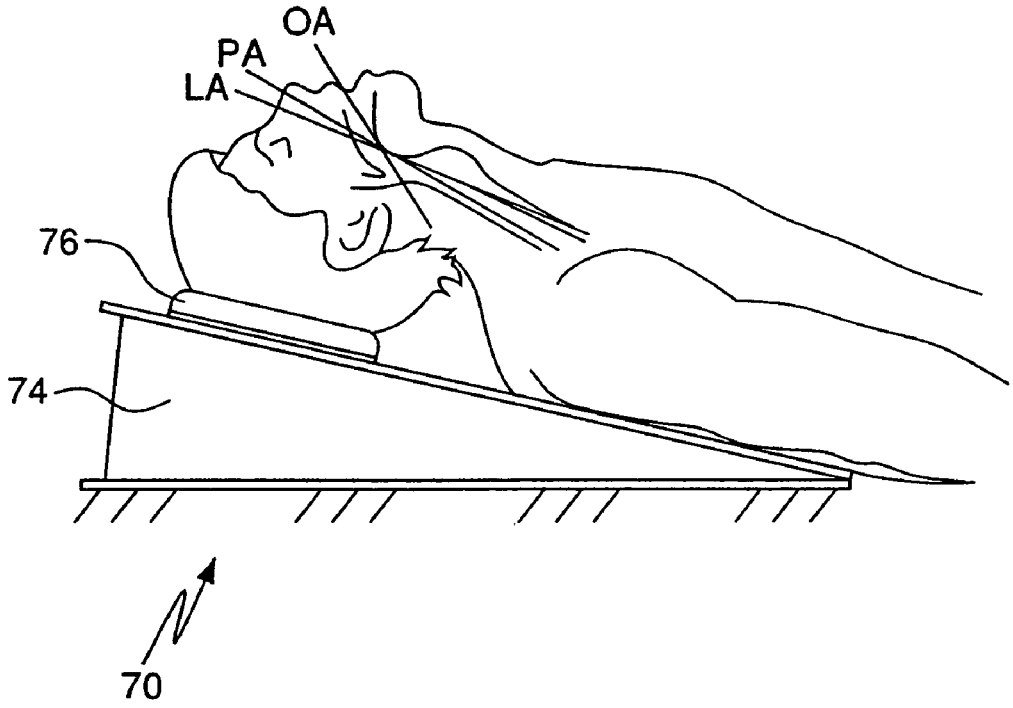
FIG. 9 is a side elevation view of a patient having head and torso supported such that the oral, pharyngeal and laryngeal axes are substantially aligned to facilitate endotracheal intubation.

It should be readily understood that any combination of head support position and torso support position can be achieved because of the independent control of the chambers 74, 80 that is provided by the inflation control system 96. According to a preferred method of controlling the torso and head support 70 for intubation, a patient is positioned on the patient transfer device with the torso and head support accessory 70 attached to the transfer mattress 68. Each of the torso and head chambers 74, 80 is then fully inflated using the control unit 104 to elevate the patient's upper torso and rotate his head slightly forward with respect to his torso. Next, the head chamber 80 is partially deflated until the three axes line up to place the patient in the above-described "sniffing position". As shown in FIG. 9, the oral, pharyngeal and laryngeal axes (respectively, OA, PA, LA) are placed in substantial alignment with the patient supported in this position. In many instances, the fully-inflated torso chamber 74 will be adequate. However, deflation of both chambers 74, 80 to a partially-inflated condition may be necessary to properly position a given patient for intubation. Moreover, it should be understood that for certain patients a full inflation of both chambers 74, 80 may result in sufficient alignment between the three axes OA, PA, LA for successful intubation to occur.

The foregoing describes the invention in terms of embodiments preferred by the inventor for which an enabling description was available, notwithstanding that insubstantial modifications of the invention, including those not presently foreseen, may nonetheless represent equivalents thereto.

What is claimed is:

1. A patient transfer device comprising:

a transfer mattress having top and bottom sheets defining an inflatable plenum, the bottom sheet having air escape holes adapted to create a cushion of air beneath the bottom sheet when the plenum is inflated, the transfer mattress including a head end portion and an opposite foot end portion, and an inflatable torso support chamber located in the head end portion adapted to incline the top sheet in the head end portion to elevate a patient's upper torso with respect to the patient's lower torso and legs, wherein the transfer mattress includes an intermediate portion between the head end portion and the foot end portion, and wherein the transfer mattress includes a pair of longitudinally-extending side air chambers and a plurality of transverse chambers extending between the side air chambers in each of the head end portion, the intermediate portion and the foot end portion, and wherein the transverse chambers in the intermediate portion are narrower than the transverse chambers of the head end portion and foot end portion.

2. The patient transfer device according to claim 1, wherein the top sheet may be inclined in the head end portion with respect to the foot end portion at an angle up to approximately 40 degrees.

3. The patient transfer device according to claim 1, wherein the torso support chamber of the transfer mattress defines an interior that is isolated from an interior of the inflatable plenum.

4. The patient transfer device according to claim 1, further including a leg separator located on an upper surface of the transfer mattress in the foot end portion, the leg separator adapted to maintain separation between the legs of a patient supported on the transfer mattress.

5. The patient transfer device according to claim 4, wherein the leg separator includes at least one inflatable chamber.

6. The patient transfer device according to claim 4, wherein the leg separator is tapered along a length of the leg separator to define a wedge-shaped formation.

7. The patient transfer device according to claim 1, further comprising an air compressor mounted to a surface of the mattress for inflating the plenum.

8. The patient transfer device according to claim 7, wherein the compressor is located on an upper surface of the transfer mattress in the foot end portion.

9. The patient transfer device according to claim 1, further comprising an inflatable head support chamber located on the torso support chamber.

10. The patient transfer device according to claim 9, wherein the inflatable head support chamber defines an interior that is separate from an interior of the torso support chamber.

11. The patient transfer device according to claim 9, wherein the inflatable head support chamber is adapted for adjustable inflation to provide a partially inflated condition.

12. A patient transfer device comprising:

a transfer mattress including top and bottom sheets and an inflatable plenum, the transfer mattress adapted to create a cushion of air beneath the bottom sheet when the plenum is inflated to facilitate sliding movement of the mattress with respect to an underlying support surface;

a torso and head support accessory releasably attached to the transfer mattress, the accessory including an upper torso support having an inflatable chamber and a head support having an inflatable chamber, the head support chamber located on an upper surface of the upper torso support chamber, the upper torso support of the accessory having an upper surface that is inclined with respect to the underlying support surface when the torso support chamber is inflated such that a patient's torso is elevated with respect to the patient's lower torso and legs;

the torso support chamber and head support chamber of the defining interiors that are separated from each other to provide for independent inflation independent inflation of the respective chambers;

an inlet tube connected to each of the torso support chamber and the head support chamber for delivery of pressurized air to the associated chamber for inflation of the chamber;

a source of pressurized air;

a distribution manifold operably connected to the source of pressurized air for receiving pressurized air, the distribution manifold including first and second valves each connected to one of the inlet tubes for controlled delivery of pressurized air to the associated chamber; and a controller connected to the distribution manifold, the controller adapted to control the operation of the valves for independent inflation of the torso support chamber and the head support chamber.

13. The patient transfer device according to claim 12 further comprising first and second exhaust tubes respectively connected to the torso support chamber and the head support chamber for discharging air from the associated chamber, and wherein the distribution manifold includes third and fourth valves each connected to one of the exhaust tubes for controlled deflation of the associated chamber.

* * * * *

UNITED STATES PATENT AND TRADEMARK OFFICE

CERTIFICATE OF CORRECTION

PATENT NO. : 7,210,176 B2
APPLICATION NO. : 11/065473
DATED : May 1, 2007
INVENTOR(S) : Robert E. Weedling et al.

It is certified that error appears in the above-identified patent and that said Letters Patent is hereby corrected as shown below:

On sheet 12, in the specification, under column 1, first paragraph, should read:

This application claims priority of U.S. Provisional Application No. 60/612,805 filed Sep. 24, 2004, entitled "Patient Transfer Mattress Having Inclined Surface", and U.S. Provisional Application No. 60/548,901, filed Mar. 2, 2004, entitled "Active Head/Neck Positioning Device for Intubation", each incorporated herein by reference in its entirety.

Signed and Sealed this
Thirtieth Day of August, 2011

David J. Kappos

David J. Kappos
*Director of the United States Patent and Trademark Office*